US005115941A

United States Patent [19]

Gueretta

[11] Patent Number: 5,115,941

[45] Date of Patent: May 26, 1992

[54] NEWSPAPER VENDING MACHINES

[76] Inventor: Ricardo Gueretta, 2917 Vendament St., Las Vegas, Nev. 89101

[21] Appl. No.: 535,766

[22] Filed: Jun. 7, 1990

[51] Int. Cl.[5] ..... B65H 1/08

[52] U.S. Cl. ..... 221/229; 221/249; 221/274

[58] Field of Search ..... 221/247, 248, 249, 268, 221/272, 274, 224, 229, 234, 213, 246

[56] References Cited

U.S. PATENT DOCUMENTS

| | | | |
|---|---|---|---|
| 533,197 | 1/1895 | Jaeger | 221/229 |
| 804,079 | 1/1905 | Williams | 221/247 |
| 965,574 | 7/1910 | Evans | 221/229 |
| 979,596 | 12/1910 | Sullivan | 221/119 |
| 1,074,496 | 9/1913 | Dodge | 221/249 |
| 1,645,442 | 10/1927 | Meyer | 221/295 |
| 1,708,621 | 9/1929 | Harvey | 221/119 |
| 1,763,352 | 6/1930 | Giles | 221/229 |
| 1,903,067 | 3/1933 | Richardson | 221/249 |
| 2,792,147 | 5/1957 | Stewart | 221/82 |
| 2,843,242 | 7/1958 | Gabrielsen et al. | 221/274 |
| 3,570,711 | 3/1971 | Young | 221/295 |
| 4,331,261 | 5/1982 | Brown | 221/249 |
| 4,367,826 | 1/1983 | Glaser | 221/213 |
| 4,506,800 | 3/1985 | Wingate | 221/6 |
| 4,508,238 | 5/1985 | Johnson | 221/107 |
| 4,700,869 | 10/1987 | Bogner | 221/229 |

*Primary Examiner*—Joseph E. Valenza
*Assistant Examiner*—Kenneth Noland
*Attorney, Agent, or Firm*—Quirk, Tratos & Roethel

[57] ABSTRACT

A newspaper vending machine has a newspaper holder with a dispensing housing that holds the newspaper in the holder. When the door of the vending machine is opened, the dispensing housing is mechanically moved from its closed position to an open position which allows a single newspaper to be dispensed down a delivery chute to a location adjacent the door for access by the customer. The dispensing housing is designed to inhibit more than one newspaper at a time from sliding down the chute. The closure of the door mechanically returns the dispensing housing to its closed position and allows another newspaper to load into the dispensing housing for delivery to the next customer.

23 Claims, 11 Drawing Sheets

NEWSPAPER VENDING MACHINES

This application relates to a newspaper vending machine, and more particularly to a newspaper vending machine that dispenses newspapers one at a time.

BACKGROUND OF THE INVENTION

Over the years many different types of newspaper vending machines have been developed. One typical design allows the customer to open the access door after depositing the required amount of coins to obtain a newspaper. Once the access door is opened, however, the customer can simply reach inside and remove as many copies of the newspaper as the customer may desire. It is of the utmost importance to newspaper publishers and suppliers to solve the great losses in distributing newspapers that occur because of the easy access or the easy means of obtaining more than one newspaper from existing vending machines.

Existing vending machines are typically of a box configuration shape to accommodate a stock of newspapers to which the consumer has access to one or more newspapers as he wishes. This creates the problem of controlling the amount of newspapers sold. Frequently, the amount of money collected in the coin box does not correspond to the number of newspapers that have been removed from the vending machine.

Another problem that arises from the use of these conventional vending machines is the lack of control between the newspaper publisher or supplier and the route men who distribute the newspapers to the vending machines because when a monetary loss does occur, there is no way of knowing whether the loss occurred from the vending machine or was caused by dishonesty on the part of the route men. The problem becomes worse on the weekends when the newspapers run many coupon specials, and particularly on Sundays when newspapers are generally more expensive than the cost of the daily edition.

It is an object of the present invention to provide a newspaper vending machine that supplies one newspaper at the time.

It is yet another object of the invention to provide a system which saves money for the suppliers, distributors and route men.

It is yet another object of the present invention to provide a vending machine system that can be used not only for newspapers but also for magazines and books.

It is a feature of the present invention that, after the customer deposits a coin, the door lock is released and the action of opening the door of the vending machine causes a single newspaper to be dispensed to a location accessible to the customer.

It is an advantage of the present invention that the newspaper vending machine operates more easily and with more control of revenue.

Other objects, features and advantages will become apparent from the following description and claims in conjunction with the accompanying drawings.

SUMMARY OF THE INVENTION

A newspaper vending machine has a newspaper holder with a dispensing housing and a bottom cover closing one end and holding the newspaper in the holder. When the door of the vending machine is opened, the dispensing housing is mechanically moved from its closed position to an open position which allows a single newspaper to be dispensed down a delivery chute to a location adjacent the door for access by the customer. The dispensing housing is designed to inhibit more than one newspaper at a time from sliding down the chute. The closure of the door mechanically returns the dispensing housing to its closed position and loads another newspaper into the dispensing housing for delivery to the next customer.

DETAILED DESCRIPTION OF A PREFERRED EMBODIMENT

Figure 1:
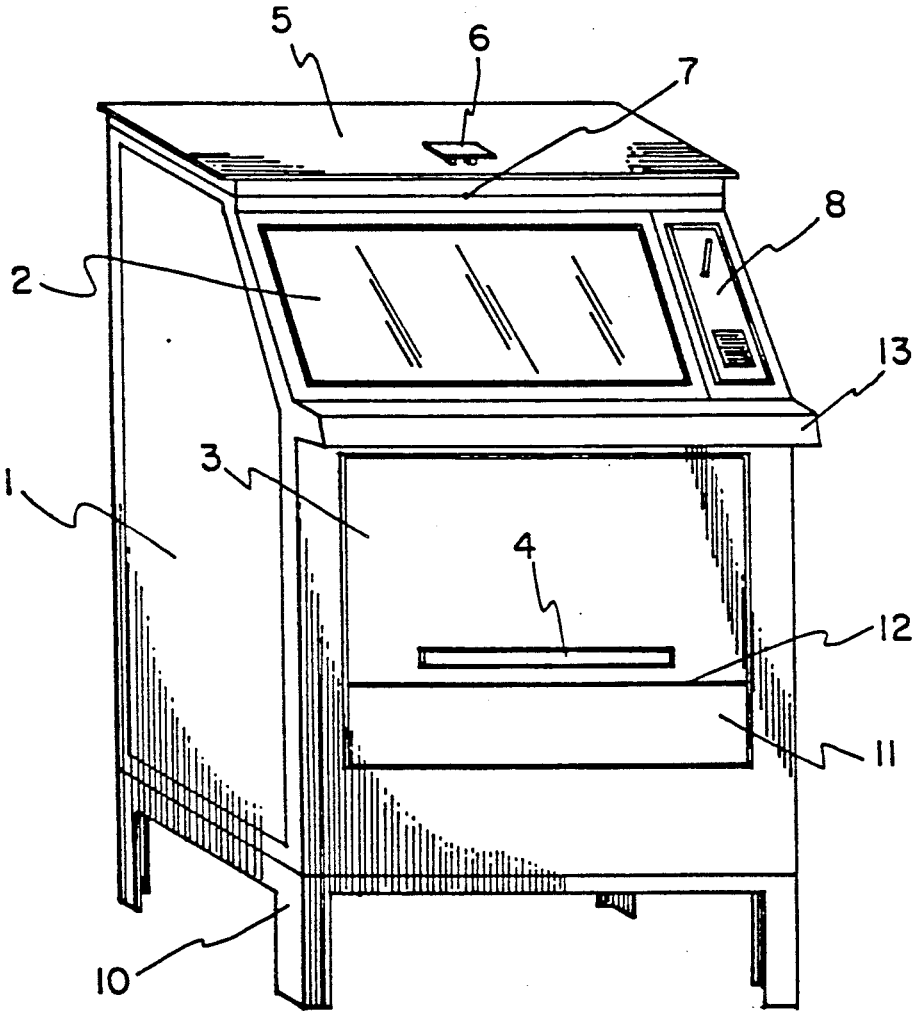
FIG. 1 is a perspective view of the vending machine of the present invention.

Referring to the drawings, where like numerals refer to like elements, a preferred embodiment of the improved mechanism of the one at a time vending machine is shown in FIG. 1.

The vending machine includes a main body frame 1 which is generally rectangular in configuration. A transparent display panel 2, made of glass, plastic or other suitable material, is provided in an upper portion of the frame 1 so that the current edition of the newspaper can be displayed. The display newspaper is mounted for viewing in the display panel 2 by a clip 50 shown in FIG. 3. The main body frame 1 is supported above the level of the ground by a plurality of legs 10.

Figure 3:
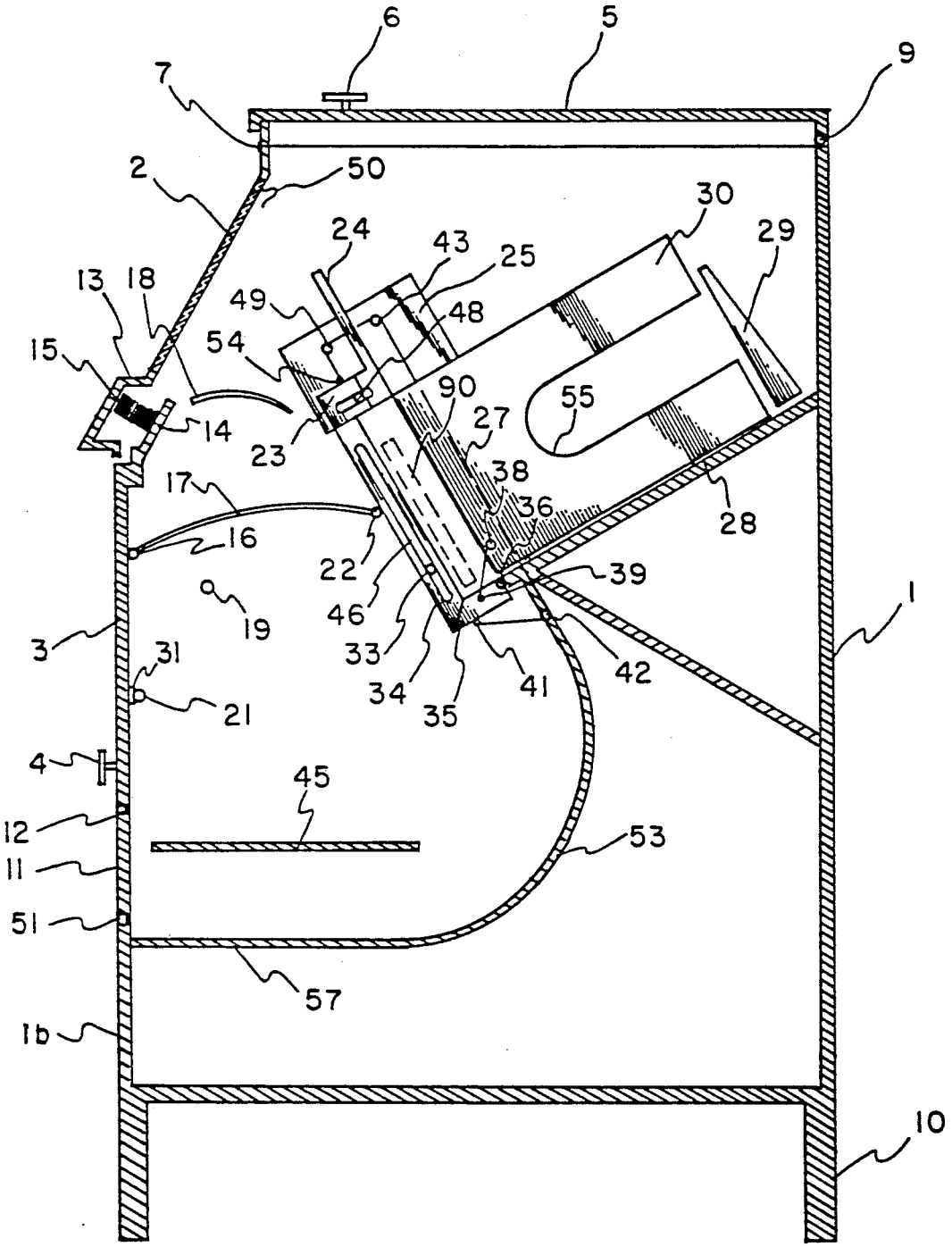
FIG. 3 is a side cutaway view of the vending machine of the present invention in a closed or passive position.
Figure 4:
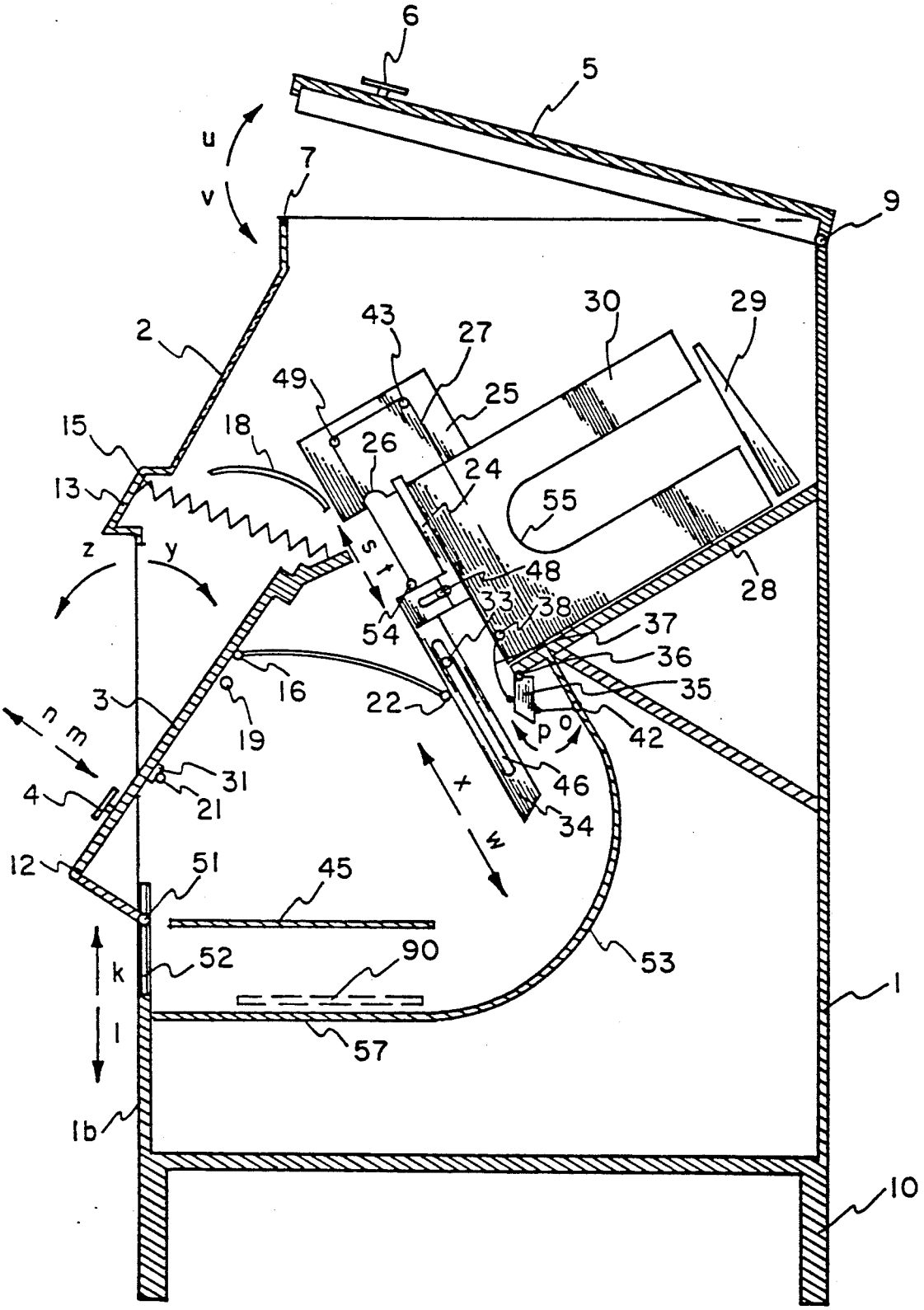
FIG. 4 is a side cutaway view of the vending machine of the present invention in an open or active position.

On the front of the main body frame 1, a front door 3 is provided. The front door 3 is mounted for pivotable movement about a pivot rod 21 as will be explained herein. The front door 3 has a handle 4 to be used to either open or close the front door as shown in FIGS. 3 and 4. The front door 3 has a lower door portion 11 attached thereto by means of a hinge 12. At each lateral side of the lower door portion 11 there is provided a roller 51 that rides in a guide slot 52 for guiding the movement of the lower door 11.

The top of the main body frame 1 is closed by a lid 5 attached by hinges 9 to the main body frame 1. The lid 5 includes a handle 6 so that the vending machine may be supplied with a stack of newspapers placed in a newspaper holder 28 with the newspapers preferably oriented in an upright position. The lid is secured by a key lock 7 or other appropriate locking device. A conventional coin mechanism 8 is provided on the front of the main body frame 1 by which the action of a coin deposited into the coin mechanism 8 releases a lock on the door 3 and allows the door 3 to be opened by the customer.

Figure 2:
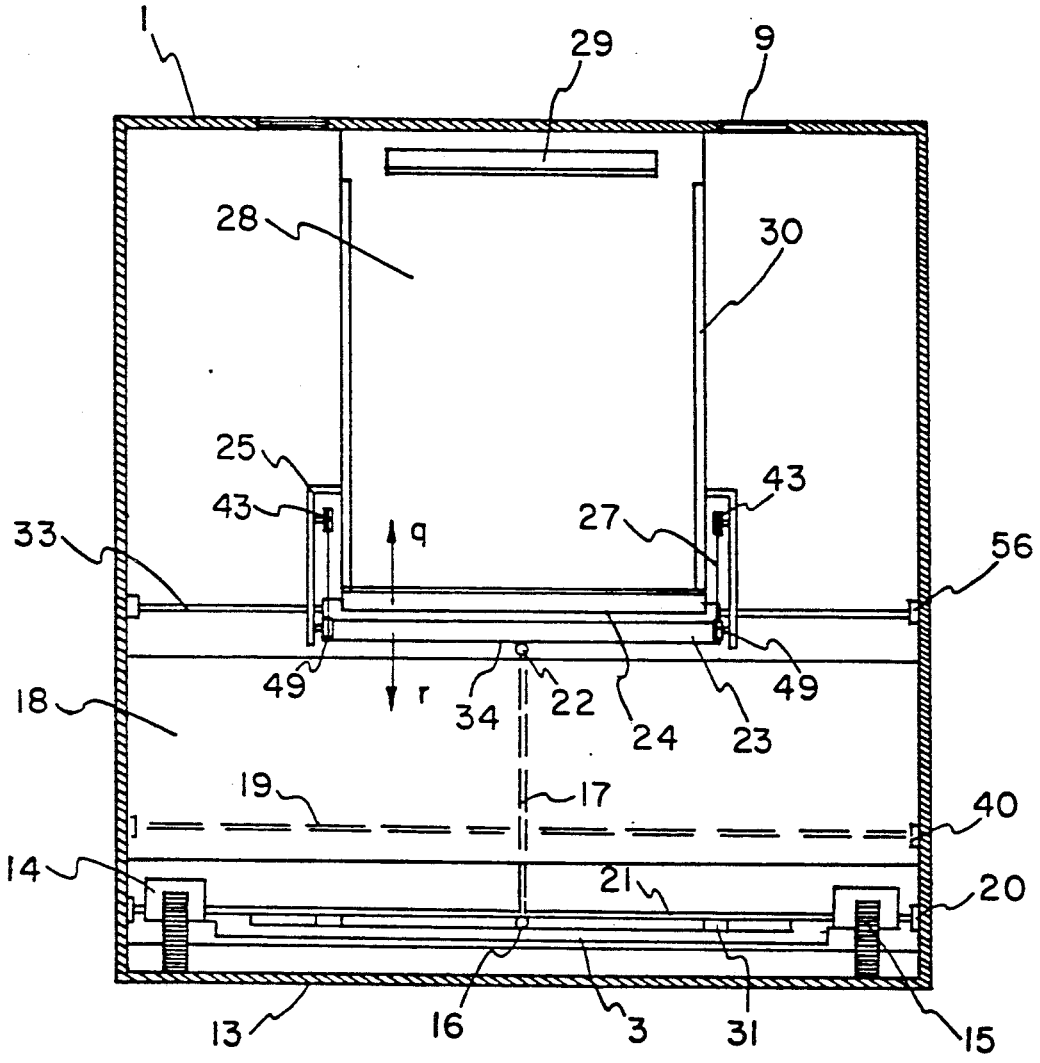
FIG. 2 is a cutaway top view looking down on the inside of the vending machine of the present invention.

In the top view looking into the vending machine of the present invention as shown in FIG. 2, the pivot rod 21 extends across the width of the interior of the main body frame 1 and is attached to the sides thereof by brackets 20. A plurality of joints 31 attach the door 3 to the pivot rod 21. A curved bar 17 is attached at its one end to the door 3 by a joint 16 and at its other end to a dispensing housing 34 by means of a joint 22.

Just below the level of the curved bar 17, a stop bar 19 extends across the interior of the main body frame 1 and is attached to the side walls by means of joints 40. Above the curved bar 17. there is mounted a curved plate 18 across the width of the main body frame.

The dispensing housing 34 has a dispensing rod 33 that extends therethrough and the dispensing rod 33 is mounted to the interior walls of the main body frame 1 by means of joints 56. The dispensing rod 33 slides in channels 46 in the dispensing housing 34 as will be more fully explained.

Referring to FIGS. 3 and 4, the newspapers to be dispensed are placed in the generally rectangular newspaper holder 28 which is oriented inside the newspaper vending machine at an angle of 30° or less to vertical. The newspaper holder 28 is provided with upstanding sidewalls 30 defining the width of the holder 28. A movable weight pusher 29 rests against the stack of newspapers to urge them toward the dispensing area at the end of the newspaper holder 28. So that only one newspaper is dispensed at a time, the dispensing area should be approximately the thickness of a single newspaper; the size of the dispensing area is adjustable, as will be more fully explained, to accommodate newspapers of different thicknesses.

Newspapers are positioned for dispensing at the end of the newspaper holder 28 in a dispensing area defined by the dispensing housing 34 and a bottom cover 35. The bottom cover 35 is pivotally mounted to the newspaper holder 28 by means of a hinge 36 and is biased in the position shown in FIG. 3 by means of a spring 37. One end of the spring 37 is attached at 38 to the newspaper holder 28 and the other end of the spring is attached at 39 to the bottom cover 35.

Attached to the lower portion of the newspaper holder 28 is a delivery chute 53 that curves around to an end 57 located adjacent the lower door portion 11 of the door 3. When the newspaper to be dispensed falls out of the dispensing housing 34, it will slide down the delivery chute 53 to the end 57 where it will be accessible to the customer through the lower portion 11 of the door 3.

The top of the dispensing housing 34 is closed by a top cover 23 which has a stopper 24 joined thereto by means of an adjustable key bolt 48 that rides in a slot 47 (see FIG. 4). By means of the key bolt 48 being appropriately located in the slot 47, different sizes of newspapers entering the dispensing area can be accounted for since often the Sunday edition of the newspaper is quite thicker than the weekday edition.

The operation of the vending machine of the present invention will be described in connection with FIGS. 3 and 4. FIG. 3 shows the vending machine in its closed position with a newspaper 90 (shown in phantom) resting in the dispenser housing 34. FIG. 4 shows the vending machine in its open position with the newspaper 90 (shown in phantom) resting at the end 57 of the delivery chute 53 so that it is accessible to a customer.

As shown in FIG. 3, the door 3 is biased closed by means of a spring 15 mounted at its one end to a protrusion 13 at the bottom of the display panel 2. Alternatively, in lieu of the spring 15, other appropriate closing devices could be used, such as hydraulic piston and cylinders located on each lateral end of the door 3. The other end of the spring 15 is connected to an extension 14 on the door 3. When the door 3 is closed, the lower door portion 11 is aligned with the rest of the door 3 because the hinge 12 is lying flat. This prevents a customer from reaching inside the door and having access to the end 57 of the delivery chute 53.

Also when the door 3 is closed, the curved bar 17 holds the dispensing housing 34 in its upward position so that it closes off the end of the newspaper holder 28. The bottom cover 35 of the dispensing housing 34 is closed by means of the bias spring 37.

After a customer inserts the proper coinage into the coin mechanism 8 and the lock on the door 3 is released, the customer pulls on the handle 4 of the door 3 which causes the door 3 to pivot about the pivot rod 21. The upper end of the door 3 pivots inwardly around pivot rod 21 until it reaches stop bar 19. Since curved bar 17 is fixedly mounted to the upper end of the door 3, curved bar 17 also moves which forces the dispensing housing 34 downward in the direction marked W in FIG. 4. The movement of the dispensing housing 34 is controlled by the dispensing rod 33 which rides in the channel 46 in the dispensing housing 34. The top cover 23 and the stopper 24 also moves downwardly since it is mounted on the dispensing housing 34 and the stopper 24 blocks the end of the newspaper holder 28 and prevents more than one newspaper from entering the dispensing area.

The downward movement of the dispensing housing 34 causes the bottom cover 35 to pivot about hinge 36 thereby eliminating the bottom support on the newspaper 90 allowing the newspaper 90 to fall onto the delivery chute 53. The bottom cover 35 is caused to pivot through the force exerted on it by cable 27.

One end of the cable 27 is attached at 41 to the bottom cover 35. The cable 27 passes around an idler wheel 42 mounted on the delivery chute 53 and along the outside of the newspaper holder 28 to a second idler wheel 43 and a third idler wheel 49, both of which are mounted on a holder plate member 25 attached to the front upper portion of the wall 30 of the newspaper holder 28 and at the front bottom end has a semicircular cutout section 26 to allow key bolt 48 to be adjusted. The second end of the cable 27 is attached at 54 to the top cover 23 mounted on the dispensing housing 34. (As shown in FIG. 2, there are two cables 27, one on each lateral end of the newspaper holder.)

As also shown in FIG. 4, the lower door portion 11 pivots about the hinge 12 and the wheel 51 on the end of the lower door portion 11 rides upwardly in the slot 52. This creates an access opening for the customer to reach the newspaper 90 which has now slid down to the end 57 of the delivery chute 53.

After the customer has retrieved the newspaper and releases the handle 4, the door 3 closes due to force of the bias spring 15. The dispensing housing 34 is pulled upwardly by curved bar 17 into the closed position. The bottom cover 35 also closes up due to bias spring 37 and due to the fact that the force of the cable 27 is relieved by the upward movement of the dispensing housing 34. The stopper 24 also moves up and out of the way of the dispensing area allowing the next newspaper in line to slid into the dispensing area for the next customer.

Figure 5:
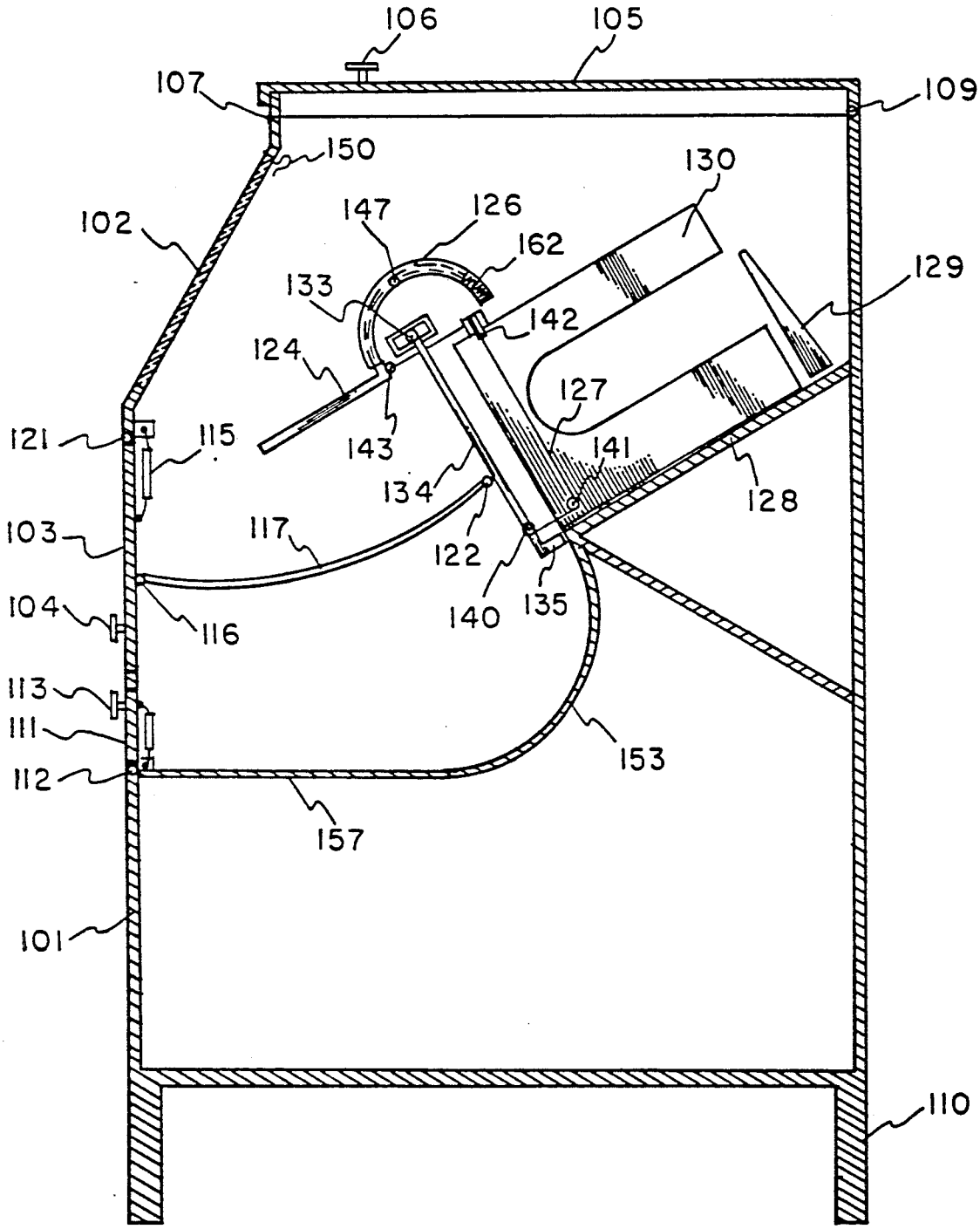
FIG. 5 is a side cutaway view of a first alternative embodiment of the vending machine of the present invention in a closed or passive position.
Figure 6:
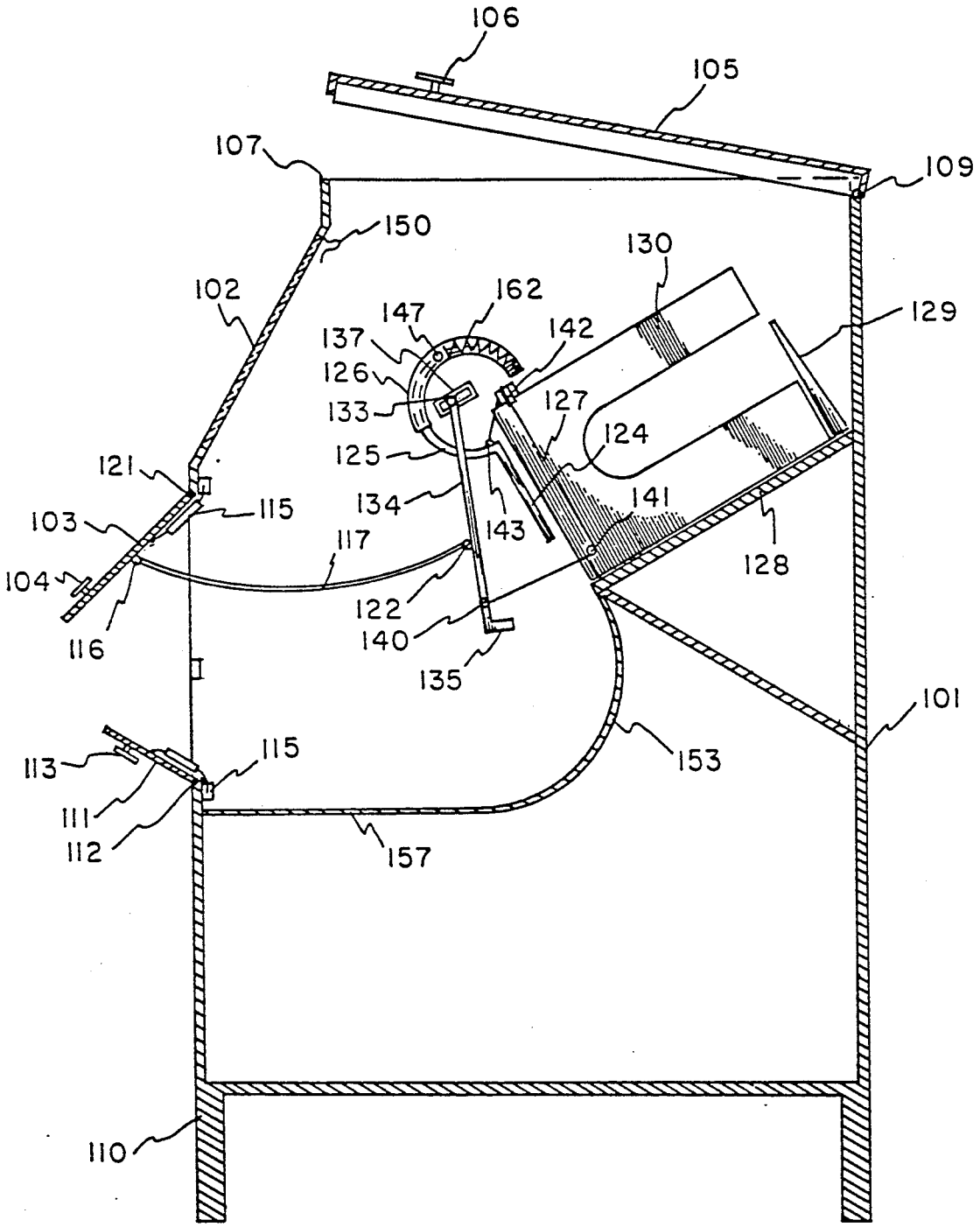
FIG. 6 is a side cutaway view of the first alternative embodiment of the vending machine of the present invention in an open or active position.
Figure 7:
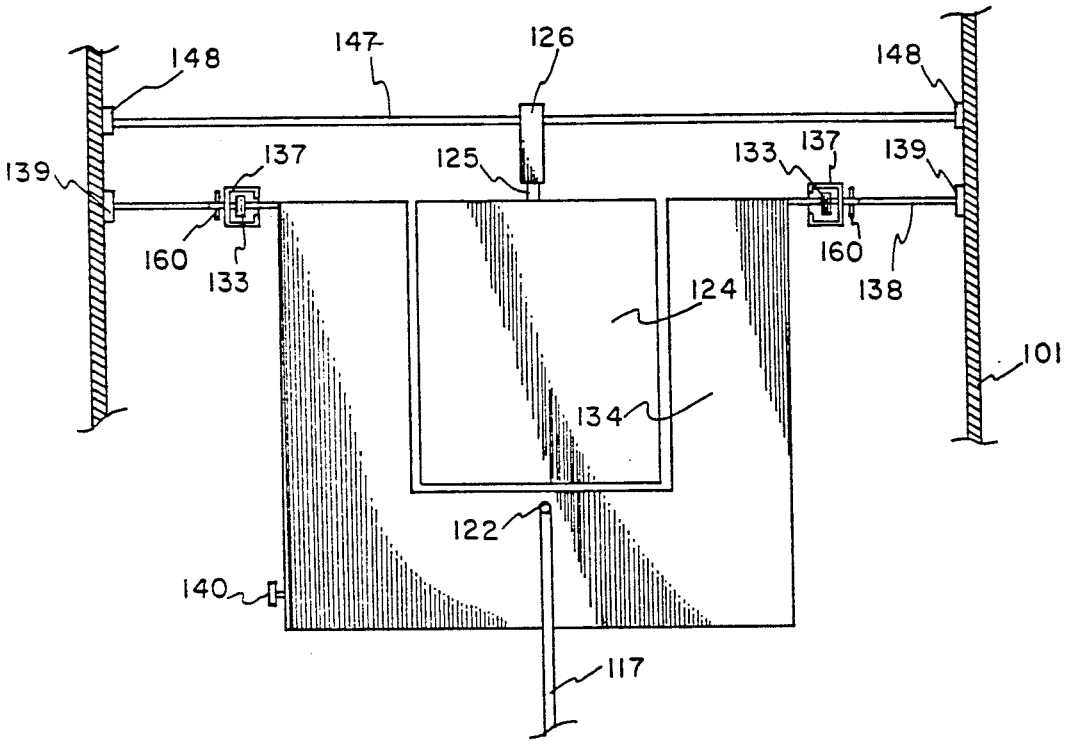
FIG. 7 is a cutaway partial front view looking into the inside of the first alternative embodiment of the vending machine of the present invention.

A first alternative embodiment of the vending machine of the present invention is shown in FIGS. 5, 6 and 7. The vending machine includes a main body frame 101 which is generally rectangular in configuration. The main body frame 101 is supported above the level of the ground by a plurality of legs 110.

On the front of the main body frame 101, an upper door 103 is provided. The upper door 103 is mounted for pivotable movement about a pivot member 121 as will be explained herein. The upper door 103 has a handle 104 to be used to either open or close the upper door 103 as shown in FIGS. 5 and 6. There is also provided a lower door 111 attached to the main body frame 101 by means of a pivot member 112. The lower door also has a handle 113 by which the lower door 111 can be opened or closed.

The top of the main body frame 101 is closed by a lid 105 attached by a hinge 109 to the main body frame 101. The lid 105 includes a handle 106 so that the vending machine may be supplied with a stack of newspapers placed in a newspaper holder 128 with the newspapers preferably oriented in an upright position. The lid is secured by a key lock or other appropriate locking device. A conventional coin mechanism is provided on the front of the main body frame 101 by which the action of a coin deposited into the coin mechanism releases a lock on the doors 103 and 111 and allows the doors to be opened by the customer.

Referring to FIGS. 5 and 6, the newspapers to be dispensed are placed in the generally rectangular newspaper holder 128 which is oriented inside the newspaper vending machine at an angle of 30° or less to vertical. The newspaper holder 128 is provided with upstanding sidewalls 130 (only one of which is shown) defining the width of the holder 128. A movable weight pusher 129 rests against the stack of newspapers to urge them toward the dispensing area at the end of the newspaper holder 128. So that only one newspaper is dispensed at a time, the dispensing area should be approximately the thickness of a single newspaper.

Newspapers are positioned for dispensing at the end of the newspaper holder 128 in a dispensing area defined by the dispensing plate 134 which includes a lower edge portion 135. The lower edge portion 135 supports a newspaper positioned in the dispensing area until the dispensing plate 134 is moved to provide for the dispensing of the newspaper as will be more fully explained herein. The dispensing plate 134 is connected to the upper door 103 by means of a curved bar 117. One end of the curved bar 117 is connected to the upper door 103 at 116 and the other end of the curved bar 117 is connected to the dispensing plate 134 at 122.

Figure 8:
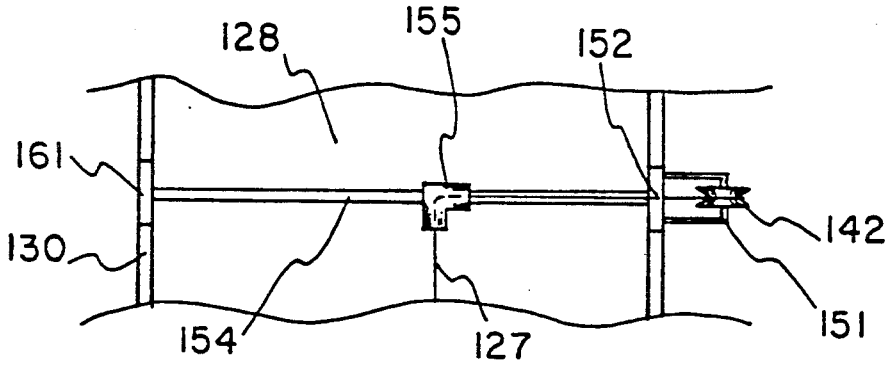
FIG. 8 is a detail top view showing the routing of a portion of the cable system of the first alternative embodiment of the vending machine of the present invention.
Figure 9:
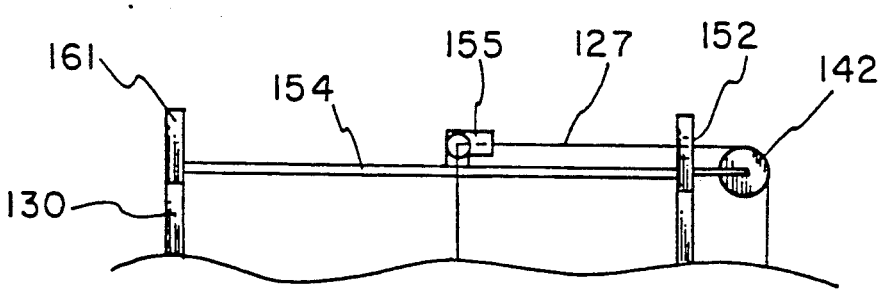
FIG. 9 is a detail front view showing the routing of a portion of the cable system shown in FIG. 8.
Figure 10:
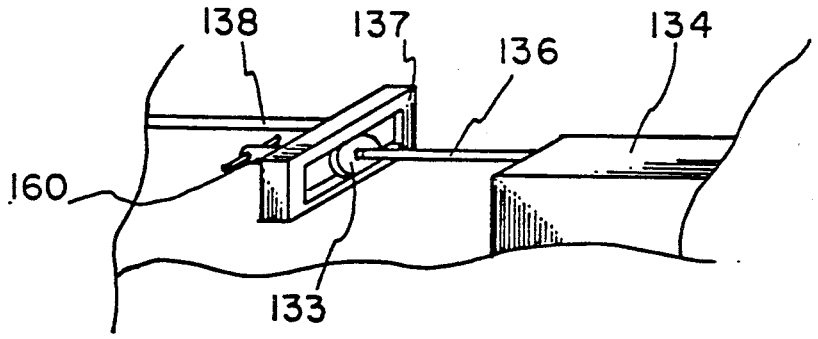
FIG. 10 is a perspective detail view of a portion of the first alternative embodiment of the vending machine of the present invention.

The dispensing plate 134 is mounted for pivotal movement as shown in FIGS. 5, 6 and 7, and portions of this construction is shown in detail in FIGS. 8, 9 and 10. Each upper lateral end of the dispensing plate 134 has an extension arm 136 carrying a guide wheel 133 that is slotted into a rail member 137 which in turn is mounted on the interior of the main body frame 101 by means of mounting arms 138 connected at 139 to the wall of the main body frame 101. The rail member 137 includes an adjustable stop key 160 that can be manually positioned along the length of the rail member to secure the position of the guide wheel 133 inside the rail member 137. The selection of the location of the guide wheel 133 in the slotted rail member 137 determines the width of the newspaper dispensing area and therefore different sizes of newspapers entering the dispensing area can be accounted for since often the Sunday edition of the newspaper is quite thicker than the weekday edition.

Also mounted for pivotal movement is a stopper plate 124. The stopper plate 124 is joined to a guide arm that slides inside a generally U-shaped guide member 126. The guide member 126 is positioned on the interior of the main body frame 101 by a rod member 147 that extends between the side walls of the main body frame 101 and is attached thereto at 148. At one end of the guide member 126, there is provided a bias spring 129 that biases the stopper plate 124 in its inoperative position shown in FIG. 5 as will be more fully explained herein.

The shape of the stopper plate 124 is selected to conform to a cutout section in the upper area of the dispensing plate 134. The stopper plate 124 and the dispensing plate 134 are configured to pivot in opposite directions to each other during the dispensing of a newspaper. A cable system is used to control the relative movement of the dispensing plate 134 and the stopper plate 124.

As shown in FIGS. 5 and 6 and in the detail views in FIGS. 8 and 9, a cable 127 is stretched between the dispensing plate 134 and the stopper plate 124. One end of the cable 127 is connected at 140 to the lower end of the dispensing plate 134. The cable 127 then passes around a first idler wheel 141 on the lower end of the newspaper housing 128 up to a second idler wheel 142 mounted on a support 151 on the upper end of one of the side walls 130 of the newspaper housing 128. After the cable 127 turns around the second idler wheel 142, the cable 127 passes through an aperture 152 in an extension 153 of the side wall 130. In the approximate center of a strut 154 across the top of the newspaper housing 128, an L-shaped hollow tube member 155 is provided that receives the cable 127 and turns the cable 127 at a 90° angle. Finally cable 127 is attached to the stopper plate 124 at 143 which is the approximate center thereof.

Attached to the lower portion of the newspaper holder 128 is a delivery chute 153 that curves around to an end 157 located adjacent the lower door 111. When the newspaper to be dispensed falls out of the dispensing area, it will slide down the delivery chute 153 to the end 157 where it will be accessible to the customer through the lower door 111.

The operation of this first alternative embodiment of the vending machine of the present invention will be described in connection with FIGS. 5 and 6. FIG. 5 shows the vending machine in its closed position prior to having the newspaper dispensed. FIG. 6 shows the vending machine in its open position after the newspaper has been dispensed from the newspaper holder 128 and accessible to a customer through open lower door 111.

As shown in FIG. 5, the door 103 is biased closed by means of a hydraulic piston-cylinder device 115 (or other suitable closure device such as the spring system shown in FIG. 3) mounted at its one end to the main body frame 101 and at its other end to the upper door 103. When the door 103 is closed, the curved bar 117 holds the dispensing plate 134 in its upward position so that it closes off the end of the newspaper holder 128. The lower edge portion 135 of the dispensing plate 134 closes off the lower edge of the newspaper holder 128 and holds the newspaper in place prior to dispensing.

After a customer inserts the proper coinage into the coin mechanism and the lock on the doors 103 and 111 is released, the customer pulls on the handle 104 of the door 103 which causes the door 103 to pivot about the pivot member 121. Since curved bar 117 is fixedly mounted to the door 103, curved bar 117 also moves which causes the dispensing plate 134 to pivot in the rail member 137. The movement of the dispensing plate 134 moves the lower edge 135 away from beneath the newspaper and allows the newspaper to fall into the delivery chute 153 where it slides to a point adjacent the lower door 111.

At the same time that the dispensing plate 134 moves in the direction away from the newspaper holder 128, the stopper plate 124 moves, under the force of the cable 127, toward the newspaper holder 128 to hold the next newspaper in line and prevent more than one newspaper from falling into the delivery chute 153. This relative movement into the newspaper dispensing position is shown in FIG. 6. Because the cable 127 is attached to the one side of the dispensing plate 134 and the center of the stopper plate 124, the movement of the dispensing plate 134 also causes the stopper plate 124 to be pulled toward the newspaper housing 128 to effect stopping of the next newspaper in line from falling into the delivery chute 153.

After the customer has retrieved the newspaper and releases the handles 104 and 113, the door 103 closes due to force of the closure device 115. The dispensing plate 134 is pushed upwardly by means of the curved bar 117 into the closed position. The stopper plate 124 is also pulled up and out of the way of the dispensing area by the force of the bias spring 129 allowing the next newspaper in line to slid into the dispensing area for the next customer. The upward movement of the dispensing plate 134 is also assisted by the cable 127 due to the movement of the stopper plate 124.

Figure 11:
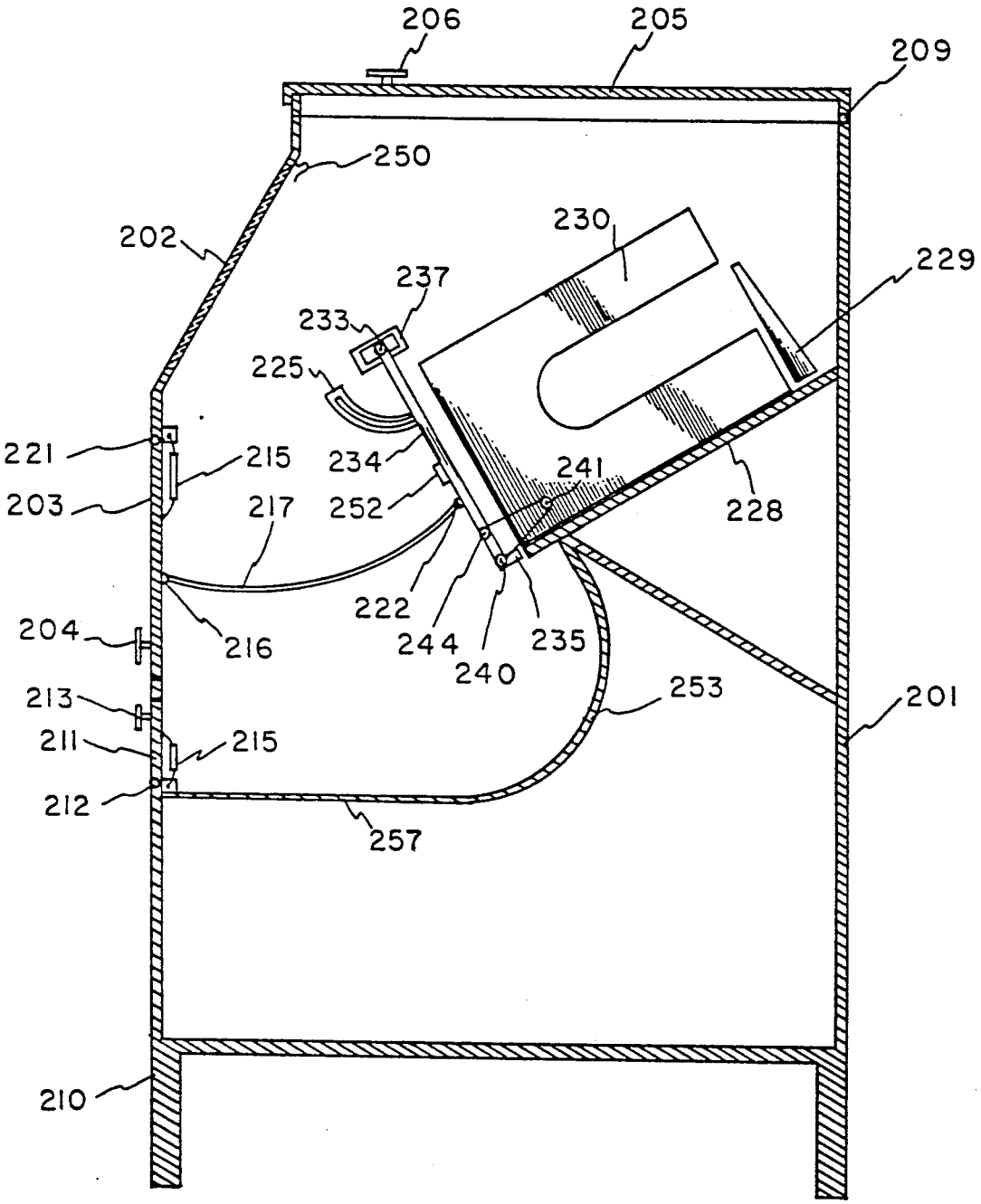
FIG. 11 is a side cutaway view of a second alternative embodiment of the vending machine of the present invention in a closed or passive position.
Figure 12:
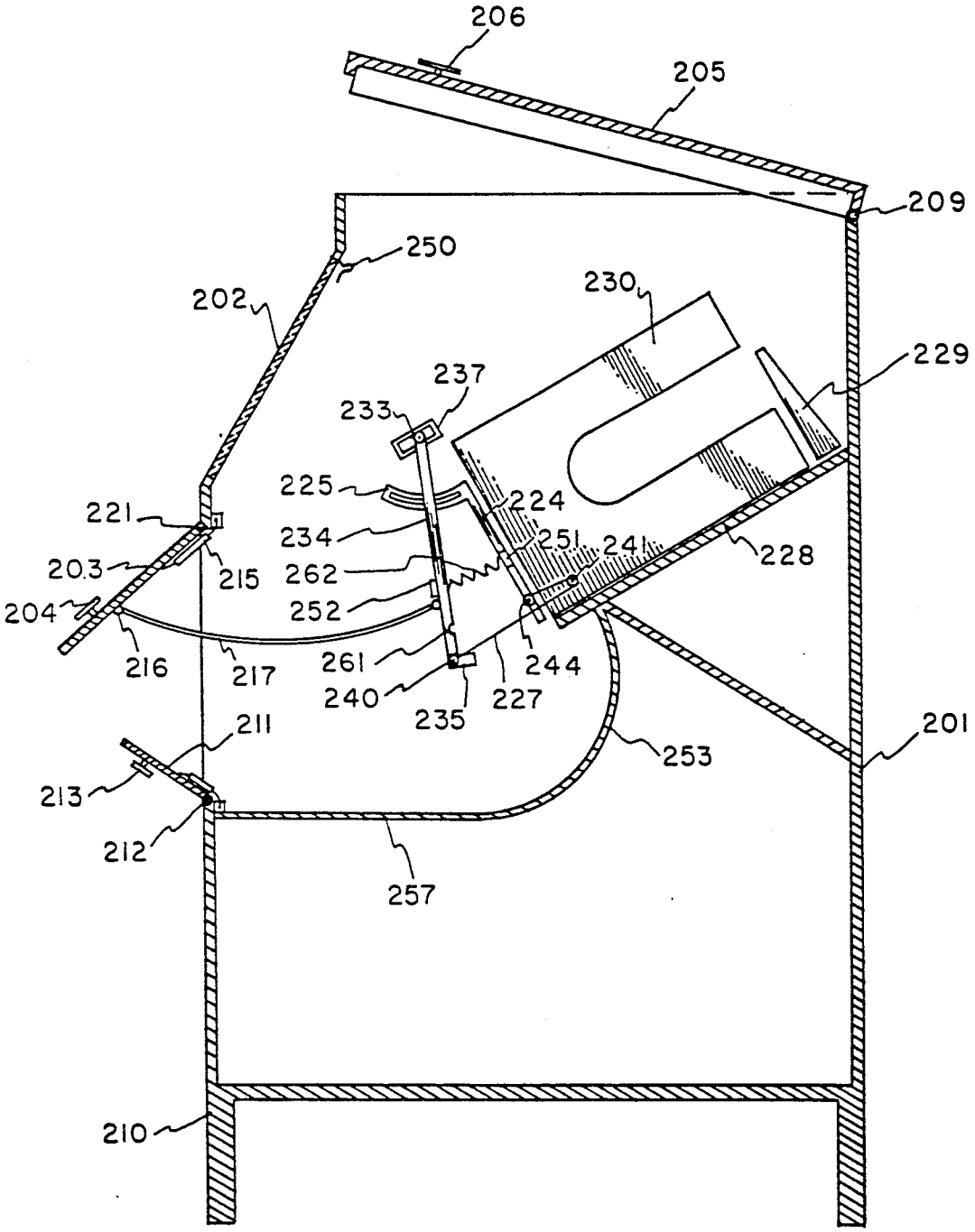
FIG. 12 is a side cutaway view of the second alternative embodiment of the vending machine of the present invention in an open or active position.
Figure 13:
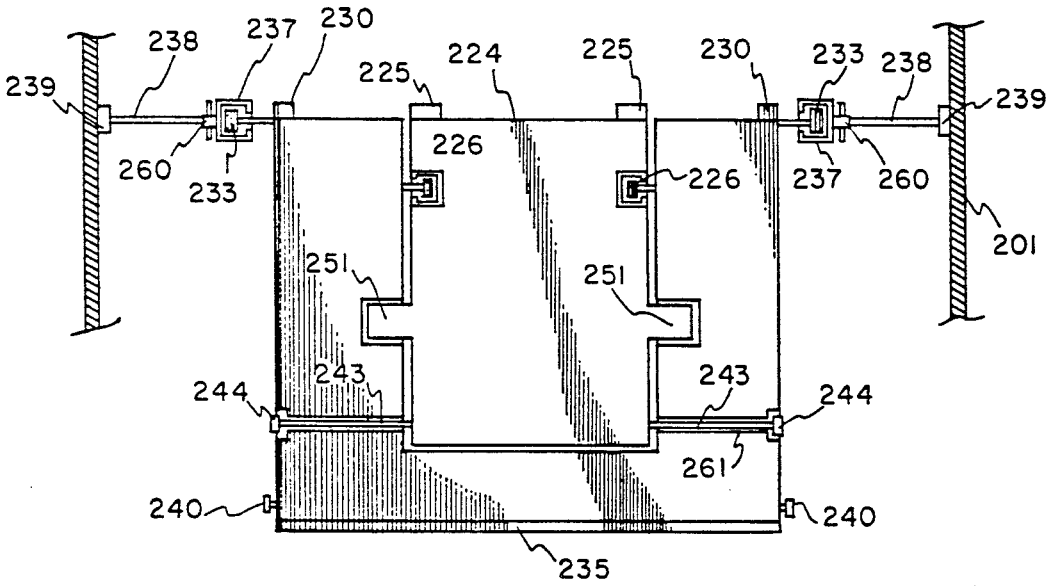
FIG. 13 is a cutaway front view looking into the inside of the second alternative embodiment of the vending machine of the present invention.

A second alternative embodiment of the vending machine of the present invention is shown in FIGS. 11, 12 and 13. The vending machine includes a main body frame supported above the level of the ground by a plurality of legs and has upper and lower doors providing access to the interior of the vending machine to dispense and retrieve a newspaper in the manner shown in FIGS. 8 and 9.

Referring to FIGS. 11, 12 and 13, the newspapers to be dispensed are placed in the generally rectangular newspaper holder 228 which is oriented inside the newspaper vending machine at an angle of 30° or less to vertical. The newspaper holder 228 is provided with upstanding sidewalls 230 (only one of which is shown) defining the width of the holder 228. A movable weight pusher 229 rests against the stack of newspapers to urge them toward the dispensing area at the end of the newspaper holder 228.

Newspapers are positioned for dispensing at the end of the newspaper holder 228 in a dispensing area defined by the dispensing plate 234 which includes a lower edge portion 235. So that only one newspaper is dispensed at a time, the dispensing area should be approximately the thickness of a single newspaper and the thickness of the newspaper dispensing area is adjusted by means of the rail member 237 (in the same manner as explained above in connection with FIG. 10). The lateral position of the guide wheel 233 is located in the rail member 237 by means of the adjustable stop key 260.

The lower edge portion 235 supports a newspaper positioned in the dispensing area until the dispensing plate 234 is moved to provide for the dispensing of the newspaper as will be more fully explained herein. The dispensing plate 234 is connected to the upper door 203 by means of a curved bar 217. One end of the curved bar 217 is connected to the upper door 203 at 216 and the other end of the curved bar 217 is connected to the dispensing plate 234 at 222.

The dispensing plate 234 is mounted for pivotal movement as shown in FIGS. 11, 12 and 13. Each upper lateral end of the dispensing plate 234 has an extension arm 236 that is slotted into the rail member 237 which in turn is mounted on the interior of the main body frame 201 by means of mounting arms 238 connected at 239 to the wall of the main body frame 201.

Also mounted for pivotal movement is a stopper plate 224. The stopper plate 224 has a guide slot 225 on each lateral side of the stopper plate 224. A pair of guide wheels 226 are mounted on the dispensing plate 234 and each guide wheel 226 rides in one of the guide slots 225 on the stopper plate 224. As shown in FIG. 12, there is provided a bias spring 229 that is joined between the stopper plate 224 and the dispensing plate 234. In the preferred embodiment, two guide springs 229 are provided, one on each lateral side of the stopper plate 224. Each guide spring 229 is connected at one end to an arm extension 251 on the side of the stopper plate 224 and at its other end to recess 252 on the dispensing plate 234. The recess 252 also provides a space to store the guide spring 229 when the guide spring 229 is compressed when the dispensing plate 234 and stopper plate 224 are aligned as shown in FIG. 11.

The shape of the stopper plate 224 is selected to conform to a cutout section in the upper area of the dispensing plate 234. The stopper plate 224 and the dispensing plate 234 are configured to pivot in opposite directions to each other during the dispensing of a newspaper. A cable system is used to control the relative movement of the dispensing plate 234 and the stopper plate 224.

As shown in FIGS. 11 and 12, a cable 227 is stretched between the dispensing plate 234 and the stopper plate 224. In the preferred embodiment, two cable systems are used, one on each lateral side of the newspaper holder 228. One end of the cable 227 is connected at 240 to the lower end of the dispensing plate 234. The cable 227 then passes around an idler wheel 241 on the lower end of the newspaper housing 228 and then is attached to the stopper plate 224. This connection of the cable 227 to the stopper plate 224 is effected by means of an arm 243 extending from the lower end of the stopper plate 243. The lower end of the dispensing plate 234 is provided with a lateral recessed channel 253 to accommodate the arm 243 when the stopper plate 224 and the dispensing plate 234 are aligned as shown in FIG. 11.

The operation of this second alternative embodiment of the vending machine of the present invention will be described in connection with FIGS. 11 and 12. FIG. 11 shows the vending machine in its closed position prior to having the newspaper dispensed. FIG. 12 shows the vending machine in its open position after the newspaper has been dispensed from the newspaper holder 228 and accessible to a customer through open lower door 211.

As shown in FIG. 11, the door 203 is biased closed by means of a closure device 215, such as a hydraulic piston-cylinder arrangement, mounted at its one end to the main body frame 201 and at its other end to the upper door 203. When the door 203 is closed, the curved bar 217 holds the dispensing plate 234 in its upward position so that it closes off the end of the newspaper holder 228. The lower edge portion 235 of the dispensing plate 234 closes off the lower edge of the newspaper holder 228 and holds the newspaper in place prior to dispensing.

After a customer inserts the proper coinage into the coin mechanism and the lock on the doors 203 and 211 is released, the customer pulls on the handle 204 of the door 203 which causes the door 203 to pivot about the pivot member 221. Since curved bar 217 is fixedly mounted to the door 203, curved bar 217 also moves which causes the dispensing plate 234 to pivot in the rail member 237. The movement of the dispensing plate 234 moves the lower edge 235 away from beneath the newspaper and allows the newspaper to fall into the delivery chute where it slides to a point adjacent the lower door 211.

At the same time that the dispensing plate 234 moves in the direction away from the newspaper holder 228, the retaining plate 224 moves slightly toward the newspaper holder 228, under the force of the cable 227, to hold the next newspaper in line and prevent more than one newspaper from falling into the delivery chute. This relative movement into the newspaper dispensing position is shown in FIG. 12. Because the cable 227 is attached to both the dispensing plate 234 and the stopper plate 224, the movement of the dispensing plate 234 also causes the stopper plate 224 to be held toward the newspaper housing 228 to effect stopping of the next newspaper in line from falling into the delivery chute.

After the customer has retrieved the newspaper and releases the handles 204 and 213, the door 203 closes due to force of the closure device 215. The dispensing plate 234 is pushed upwardly by means of the curved bar 217 into the closed position. The upward movement of the dispensing plate 234 is also assisted by the bias spring 229 which pulls the stopper plate 224 towards the dispensing plate 234 to provide space for the next newspaper in line to be readied for dispensing.

By merely adjusting the size of the newspaper holder, the vending machine of the present invention can be adjusted to dispense magazines or even books.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A newspaper vending machine comprising:

a) a frame, b) a newspaper holder mounted inside the frame, c) a dispensing housing mounted at one end of the newspaper holder, the dispensing housing be reciprocal between a closed position which supports a newspaper in the newspaper holder and a open position which allows the newspaper to be dispensed, d) a door mounted in the frame, the door being connected by means of a bar to the dispensing housing e) and a bottom cover attached to the newspaper holder to assist the dispensing housing in closing the newspaper holder whereby when the door is opened, the dispensing housing moves from the closed position to the open position to dispense a newspaper.

2. The newspaper vending machine of claim 1 wherein the dispensing housing reciprocates on a dispensing rod disposed on the interior of the frame.

3. The newspaper vending machine of claim 2 wherein the dispensing rod rides in a slot on the dispensing housing.

4. The newspaper vending machine of claim 1 wherein the bottom cover is pivotally attached to the newspaper holder and biased in its closed position by a spring.

5. The newspaper vending machine of claim 1 wherein a top cover is attached to the newspaper holder and width of the top cover is adjustable so that the dispensing housing can accommodate newspapers of varying thicknesses.

6. The newspaper vending machine of claim 5 wherein the top cover includes a stopper that prevents a newspaper from sliding into the dispensing housing when the dispensing housing is in its open position.

7. The newspaper vending machine of claim 5 wherein a cable is attached to the top cover and to the bottom cover so that the reciprocal movement of the dispensing housing causes the bottom cover to open.

8. The newspaper vending machine of claim 1 further including a delivery chute attached to the newspaper holder for delivering the dispensed newspaper to a location adjacent the door so tat the dispensed newspaper is accessible by a customer.

9. The newspaper vending machine of claim 1 further including a lid on the top of the frame so that the newspaper holder is accessible for inserting newspapers therein in an upright position.

10. The newspaper vending machine of claim 1 further including a display panel in the frame and a mounting clip attached adjacent the display panel for displaying a newspaper to a customer.

11. The newspaper vending machine of claim 1 further including a coin mechanism mounted on the frame for receiving a coin and unlocking the door so that the newspaper can be dispensed to the customer.

12. A newspaper vending machine comprising:

a) a frame, b) a newspaper holder mounted inside the frame, c) a dispensing housing mounted at one end of the newspaper holder, the dispensing housing be reciprocal between a closed position which supports a newspaper in the newspaper holder and a open position which allows the newspaper to be dispensed, d) a door mounted in the frame, the door being connected by means of a bar to the dispensing housing e) the door being mounted for pivotable movement about a pivot rod mounted on the interior of the frame between a closed position an open position whereby when the door is opened, the dispensing housing moves from the closed position to the open position to dispense a newspaper.

13. The newspaper vending machine of claim 12 wherein the door includes a lower door portion hingedly attached to the door so that as the door pivots into the open position, the lower door portion hinges open to allow a customer access to the dispensed newspaper.

14. The newspaper vending machine of claim 13 wherein the lower door portion has a guide wheel mounted therein that rides in a track on the frame so that the movement of the lower door portion is controlled.

15. The newspaper vending machine of claim 12 wherein the door is biased to its closed position by a spring attached to the door.

16. The newspaper vending machine of claim 12 wherein the door is biased to its closed position by a hydraulic closure device attached to the door.

17. The newspaper vending machine of claim 12 wherein the door is attached to the dispensing housing by a curved bar so that the pivotable movement of the door effects the reciprocal movement of the dispensing housing.

18. The newspaper vending machine of claim 17 further a stop rod mounted on the interior of the frame for limiting the pivotable movement of the door.

19. A newspaper vending machine comprising:

a) a frame, b) a newspaper holder mounted inside the frame, c) a dispensing housing mounted at one end of the newspaper holder, and comprising a dispensing plate and a stopper plate that cooperate to dispense a single newspaper, the dispensing housing be reciprocal between a closed position which supports a newspaper in the newspaper holder and a open position which allows the newspaper to be dispensed, d) a door mounted in the frame, the door being connected by means of a bar to the dispensing housing whereby when the door is opened, the dispensing housing moves from the closed position to the open position to dispense a newspaper.

20. The newspaper vending machine of claim 19 wherein the dispensing plate and the stopper plate are pivotally mounted for opposed movement with respect to each other.

21. The newspaper vending machine of claim 20 wherein a cable system connects the dispensing plate to the stopper plate so that when the dispensing plate opens, the stopper plate moves to allow only one newspaper to be dispensed.

22. The newspaper vending machine of claim 19 wherein the dispensing plate is mounted in a rail member having an adjustable stop key for accommodating differing sized newspapers in the dispensing housing.

23. The newspaper vending machine of claim 19 wherein the stopper plate is spring-biased in a closed position.

* * * * *